US005887223A

United States Patent [19]

Sakai et al.

[11] Patent Number: 5,887,223

[45] Date of Patent: Mar. 23, 1999

[54] IMAGE FORMING APPARATUS HAVING HIGH IMAGE QUALITY CONTROL MECHANISM

[75] Inventors: Yoshihiko Sakai; Kunio Yamada; Atsushi Ogihara, all of Ashigarakami-gun, Japan

[73] Assignee: Fuji Xerox Co., Ltd., Tokyo, Japan

[21] Appl. No.: 908,804

[22] Filed: Aug. 8, 1997

[30] Foreign Application Priority Data

Aug. 13, 1996 [JP] Japan ..... 8-231386

[51] Int. Cl.[6] ..... G03G 15/01; G03G 15/14

[52] U.S. Cl. ..... 399/60; 399/15; 399/44; 399/49

[58] Field of Search ..... 399/49, 72, 39, 399/41, 43, 44, 74, 15, 60; 358/406, 504, 519, 521

[56] References Cited

U.S. PATENT DOCUMENTS

| | | | |
|---|---|---|---|
| 5,034,772 | 7/1991 | Suzuki | 399/44 |
| 5,146,274 | 9/1992 | Hattori et al. | 399/44 |
| 5,204,718 | 4/1993 | Morita | 399/74 |
| 5,483,328 | 1/1996 | Kawasaki et al. | 399/49 |
| 5,532,794 | 7/1996 | Tokuyama et al. | 399/49 |
| 5,576,811 | 11/1996 | Kobayashi et al. | 399/15 X |
| 5,682,573 | 10/1997 | Ishikawa et al. | 399/15 X |
| 5,708,915 | 1/1998 | Noguchi et al. | 399/49 |

FOREIGN PATENT DOCUMENTS

| | | |
|---|---|---|
| A-62-296669 | 12/1987 | Japan . |
| A-63-177176 | 7/1988 | Japan . |
| A-63-177177 | 7/1988 | Japan . |
| A-63-177178 | 7/1988 | Japan . |
| A-63-185279 | 7/1988 | Japan . |
| A-1-169467 | 7/1989 | Japan . |
| A-3-87859 | 4/1991 | Japan . |
| A-4-55868 | 2/1992 | Japan . |
| A-4-204461 | 7/1992 | Japan . |
| A-4-319971 | 11/1992 | Japan . |
| A-4-320278 | 11/1992 | Japan . |
| A-5-207275 | 8/1993 | Japan . |
| A-7-168412 | 7/1995 | Japan . |
| A-7-225505 | 8/1995 | Japan . |

OTHER PUBLICATIONS

Color Research and Application, vol. 14, No. 3, Jun. 1989, "Performance Testing of Color–Difference Metrics Using a Color Tolerance Dataset", David H. Alman et al., pp. 139–151.

*Primary Examiner*—Arthur T. Grimley
*Assistant Examiner*—Sophia S. Chen
*Attorney, Agent, or Firm*—Oliff & Berridge, PLC

[57] ABSTRACT

An unfixed toner image of a reference pattern is formed on a photosensitive member, the unfixed toner image is measured by a development density sensor 13, and the amount of toner to be supplied to a developing device 4 is controlled by a toner supply control unit 60 on the basis of a measurement output, thereby maintaining the image quality constant. If it is judged from a result of a detection of a state amount such as the temperature and the humidity by a state amount sensor 19 that there is a fear that the image quality exceeds an allowable range, a fixed image of a reference pattern is formed on a record medium such as a banner sheet, and the fixed image is measured by an optical sensor 10. Operation amounts such as the charge amount and the exposure value of an image output unit 100 are controlled by an image density control unit 20, thereby maintaining the image quality to be within the allowable range.

13 Claims, 10 Drawing Sheets

| CONTROL CASE NO. | STATE AMOUNT | OPERATION AMOUNT | | CONTROL AMOUNT (OUTPUT VALUE OF OPTICAL SENSOR 10) | |
|---|---|---|---|---|---|
| | Y M D H M S | SCOROTRON SET VALUE | LP SET VALUE | SOLID | HIGHLIGHT |
| CASE 1 | 960301120010 | 130 | 83 | 185 | 23 |
| CASE 2 | 960301120010 | 121 | 102 | 176 | 15 |
| CASE 3 | 960301120010 | 98 | 154 | 195 | 33 |
| | | | | | |

FIG. 15

| CONTROL CASE NO. | STATE AMOUNT | OPERATION AMOUNT | | CONTROL AMOUNT (OUTPUT VALUE OF DEVELOPMENT DENSITY SENSOR 13) | |
|---|---|---|---|---|---|
| | Y M D H M S | SCOROTRON SET VALUE | LP SET VALUE | SOLID | HIGHLIGHT |
| CASE 1 | 960301120010 | 130 | 83 | 185 | 23 |
| CASE 2 | 960301120010 | 121 | 102 | 176 | 15 |
| CASE 3 | 960301120010 | 98 | 154 | 195 | 33 |
| | | | | | |

IMAGE FORMING APPARATUS HAVING HIGH IMAGE QUALITY CONTROL MECHANISM

BACKGROUND OF THE INVENTION

1. Field of the Invention

The invention relates to an image forming apparatus of the electrophotographic type, and particularly to an image forming apparatus of the electrophotographic type in which the image quality is controlled so as to be always held to a predetermined level.

2. Description of the Related Art

Generally, it is known that the sensitivity of a human being to a color difference is very high. When the color difference ΔE between images to be compared with each other is about 5 in an L*a*b* color space, for example, the images can be distinguished from each other irrespective of the observer and conditions. It is reported that, when ΔE is about 3, many observers hardly distinguish a color difference (see D. H. Alman, R. S. Berns, G. D. Snyder, and W. A. Larsen, Performance Testing of Color-Difference Metrics Using a Color Tolerance Dataset, COLOR research and application, vol. 14, Number 3, June 1989).

From these facts, it will be seen that, when the target level of the image reproducibility is set to be within the color difference recognition limit of a human being, an image forming apparatus is required to produce a color difference as high as ΔE=3 or less.

As well known in the art, however, a prior art image forming apparatus of the electrophotographic type cannot fulfil such a high requirement. This is caused by the following reason. In an apparatus of the electrophotographic type, an electrostatic phenomenon is used, and hence the image output state of the apparatus itself is changed in accordance with the conditions of the environment where the apparatus is placed, such as the temperature and the humidity, or by temporal deterioration of a photosensitive member, a developer, or the like, with the result that the image reproducibility is varied.

To comply with this, an image forming apparatus of the electrophotographic type usually employs a feedback control to maintain the image density to an optimum level. In a control method which is most usually used, specifically, the reproduction state of the density and the environmental conditions of the interior of the apparatus are monitored by using a density patch, an error with respect to the target density is obtained, and the error is multiplied by a feedback gain, thereby calculating a correction amount of a preset value of a control actuator.

As the density patch, used is a density patch of an unfixed toner image after the developing process, or that of an image which is formed on a record medium such as a paper sheet and which has undergone the fixing process. A density patch of an unfixed toner image is used because such an image can be produced and erased more easily than a transferred image or a fixed image which is formed on a sheet, and has a high correlation of density with a fixed image. By contrast, a density patch of a fixed toner image is used because such an image itself is obtained by the user as a final image form and the quality of the image can be evaluated in consideration of factors including variation factors in the transferring and fixing processes.

As the environmental conditions of the interior of the apparatus which are to be detected, frequently, the temperature and the humidity which conspicuously affect the electrostatic phenomenon peculiar to the electrophotographic type are detected. As the control actuator, the voltage applied to the charger, the exposure value, the development bias, and the like which affect the developing properties are often used.

For example, Japanese Patent Publications (Kokai) Nos. SHO 63-177176, SHO 63-177177, and SHO 63-177178 disclose a technique in which the development density is desirably controlled by changing the development potential. Japanese Patent Publication (Kokai) No. HEI 1-169467 discloses another technique in which a density patch of a toner image is measured and exposure conditions and development bias conditions are controlled, thereby obtaining a desired image density.

However, the optimum development potential is always affected by various external factors which cannot be controlled, such as the temperature, the humidity, and the accumulated copy number. Therefore, there arises a difficulty that the development potential, the exposure value, the development bias, and the like must be set in consideration of these factors. Although a density patch of an unfixed toner image is highly correlated in density with a fixed image, it is impossible to detect an influence exerted by such factors in subsequent processes or the transferring and fixing processes.

In a method of monitoring the density of a fixed image, as typically shown in Japanese Patent Publications (Kokai) Nos. SHO62-296669 and SHO63-185279, an image reading unit incorporated into the main unit of an apparatus is often used. However, the work of transferring an image which has been once output to the image reading unit so as to be again subjected to the reading operation must be conducted by the user. As a result, this method has a disadvantage that such a very cumbersome work must be conducted in a usual image management routine.

Japanese Patent Publication (Kokai) No. HEI4-55868 discloses a technique in which the density of a fixed image is online monitored via an optical fiber, and Japanese Patent Publication (Kokai) No. HEI7-168412 discloses another technique in which such a density is online monitored by dedicated detecting means. In these methods, a test sheet must be output frequently or at each time when the image management is to be conducted. This produces a problem in that the user must bear the cost of the sheets. Since test sheets are frequently output, moreover, the image forming speed of the apparatus is substantially lowered, thereby producing a problem in that the original productivity of image formation of the apparatus is lowered.

Japanese Patent Publications (Kokai) Nos. HEI4-204461, HEI7-225505, and HEI3-87859 disclose a technique in which means for detecting conditions such as the environment is disposed and operations such as charging, exposure, and development are controlled. In the electrophotographic type in which electrostatic processes are mainly conducted, however, sufficiently high control accuracy cannot be always attained because relationships between optimum preset values of the development potential, the exposure value, and the development bias are nonlinear.

Because of these reasons, in an image forming apparatus of the electrophotographic type, effects such as those of various environmental conditions, for example, a high temperature and humidity state or low temperature and humidity state, and those of temporal deterioration of a photosensitive member, a developer, or the like must be previously known. As an apparatus of a higher control performance is to be developed, data must be collected in detail over a wider range of conditions. Therefore, enormous development manhours are required.

Furthermore, a feedback gain which is determined as a result of expending such enormous development manhours is not always optimum because of differences among apparatuses and a wide variety of use conditions. Particularly, the effect of temporal deterioration on the image density is largely varied depending on the degree of deterioration of parts used in each of apparatuses and the manner of operating each apparatus by the user. Therefore, it cannot be said that the control performance for image density is kept perfect for a long term after shipment.

Recently, methods which use a fuzzy system or a neural network system have been proposed as shown in Japanese Patent Publications (Kokai) Nos. HEI4-319971, HEI4-320278, and HEI5-207275.

In the proposed methods, however, only the control accuracy is improved by using a feature of a fuzzy system or a neural network system that it can cope with a case where the input and output relationship is complicated and non-linear. Consequently, such methods are substantially useless for solving the above-discussed problems in that a large amount of data must be collected, that enormous development manhours are required, and that the control performance of each apparatus for the image density for a long term after shipment cannot be ensured.

In a fuzzy system, a membership function must be tuned by the engineer, and, in a neural network system, the learning operation may be automated but supervisory data for learning must be previously prepared by the engineer. In this way, actually, both the methods require considerably large development manhours.

Even in the case where a fuzzy system or a neural network system is used in which data of temporal deterioration are previously collected and which is configured in consideration of the collected data, there is a problem in that, when the input and output relationship is changed by actual temporal deterioration, differences among apparatuses, or replacement of parts, it is impossible to automatically cope with such a change. In other words, even when a fuzzy system or a neural network system is used, the control performance of each apparatus for the image density for a long term after shipment cannot be ensured.

SUMMARY OF THE INVENTION

The present invention has been made in view of the above circumstances, and therefore it is a first object of the invention to, even when a control is conducted while measuring a fixed image in order to improve total image accuracy, lower the frequency of outputting a test sheet for measurement, and prevent the running cost from being increased, and the original productivity of the image formation of an apparatus from being lowered.

It is a second object of the invention to enable a control to be conducted at high accuracy without requiring the engineer to previously know effects due to various environmental conditions and temporal deterioration, thereby reducing development manhours to a very low level.

It is a third object of the invention to, even when a huge number of image forming apparatuses are produced and used in various manners and replacement of their parts is conducted as required, enable the control performance for image density of each of the apparatuses to be always automatically ensured.

It is a fourth object of the invention to measure the density of a fixed image which is the final output image, whereby a temporal change and an apparatus difference of the central value or the average value of the image quality can be controlled not in a relative manner but in an absolute manner.

According to a first aspect of the invention, an image forming apparatus comprises:

image forming means of an electrophotographic type;

toner image measuring means for measuring an unfixed toner image of a reference pattern, the unfixed toner image being formed by the image forming means;

toner supply controlling means for controlling an amount of supplied toner on the basis of an output of the toner image measuring means;

state amount detecting means for detecting a state amount relating to an image formation;

image formation controlling means for causing the image forming means to form a fixed image of a reference pattern on a record medium, on the basis of a detection result of the state amount detecting means;

fixed image measuring means for measuring the fixed image of the reference pattern, the fixed image being formed by the image forming means;

image quality controlling means for controlling a quality of an output image on the basis of an output of the fixed image measuring means; and sensitivity calibrating means for calibrating a sensitivity of the toner image measuring means on the basis of the output of the fixed image measuring means.

According a second aspect of the invention, an image forming apparatus comprises:

image forming means of an electrophotographic type;

toner image measuring means for measuring an unfixed toner image of a reference pattern, the unfixed toner image being formed by the image forming means;

toner supply controlling means for controlling an amount of supplied toner on the basis of an output of the toner image measuring means;

image quality controlling means for controlling a quality of an output image on the basis of an output of the toner image measuring means;

state amount detecting means for detecting a state amount relating to an image formation;

image formation controlling means for causing the image forming means to form a fixed image of a reference pattern on a record medium, on the basis of a detection result of the state amount detecting means;

fixed image measuring means for measuring the fixed image of the reference pattern, the fixed image being formed by the image forming means; and sensitivity calibrating means for calibrating a sensitivity of the toner image measuring means on the basis of an output of the fixed image measuring means.

According to a third aspect of the invention, the image forming apparatus of the first or second aspect of the invention is configured so that the toner image measuring means detects an amount of adhering toner of the unfixed toner image.

According to a fourth aspect of the invention, the image forming apparatus of the first or second aspect of the invention is configured so that the toner image measuring means irradiates the unfixed toner image with infrared rays and detects a density of the unfixed toner image from a quantity of reflected light or a quantity of diffused light.

According to a fifth aspect of the invention, the image forming apparatus of the first or second aspect of the invention is configured so that the fixed image measuring means detects a density of a single toner color on the record medium as the fixed image.

According to a sixth aspect of the invention, the image forming apparatus of the first or second aspect of the invention is configured so that the fixed image measuring means detects a density of a single toner color among colors of yellow, magenta, cyan, and black on the record medium as the fixed image.

According to a seventh aspect of the invention, the image forming apparatus of the first or second aspect of the invention is configured so that the fixed image measuring means detects a density of the fixed image while separating the fixed image into colors of red, green, and blue.

According to an eighth aspect of the invention, the image forming apparatus of the first or second aspect of the invention is configured so that the fixed image measuring means irradiates the fixed image with light emitted from a light emitting diode and detects a density of the fixed image from a quantity of reflected light or a quantity of transmitted light.

According to a ninth aspect of the invention, the image forming apparatus of the first or second aspect of the invention is configured so that the fixed image measuring means measures the fixed image as an image signal which is represented by an L*a*b* color space, an L*C*h color space, or an XYZ color space.

According to a tenth aspect of the invention, the image forming apparatus of the first or second aspect of the invention is configured so that the state amount detecting means detects one of a temperature, humidity, a number of sheets output by the image forming means, and an operating time period of the image forming apparatus.

According to an eleventh aspect of the invention, the image forming apparatus of the first or second aspect of the invention is configured so that the toner supply controlling means supplies toner into a developing device in accordance with a difference between a density of an unfixed toner image of an image area rate of 100% and a target value of the density.

According to a twelfth aspect of the invention, the image forming apparatus of the first or second aspect of the invention is configured so that the image quality controlling means comprises:

- image quality changing means for changing the quality of the output image in accordance with an operation amount;
- control case storing means for storing control cases of the output image;
- control rule extracting means for extracting a control rule from the plural control cases stored in the control case storing means; and
- operation amount calculating means for, by using the control rule extracted by the control rule extracting means, calculating a new operation amount so that the quality of the output image coincides with the target quality, and supplying the new calculated operation amount to the image quality changing means.

The first aspect of the invention is directed to a control system which is used in the case where the environment is not largely changed or where the image forming means is not largely affected by a change of the environment. In the image forming apparatus of the invention, usually, an unfixed toner image of the reference pattern is formed by the image forming means, the unfixed toner image is measured by the toner image measuring means, and the amount of supplied toner is controlled by the toner supply controlling means on the basis of the output of the toner image measuring means, thereby maintaining the image quality constant.

The state amount detecting means detects a state amount relating to the image formation, such as the temperature or the humidity. If the image formation controlling means judges from the result of the detection of the state amount that there is a fear that the image quality exceeds the allowable range, a fixed image of the reference pattern is formed on a record medium by the image forming means, the fixed image is measured by the fixed image measuring means, and an operation amount of the image forming means such as the charge amount or the exposure value is controlled by the image quality controlling means on the basis of the output of the fixed image measuring means, thereby causing the image quality to be within the allowable range.

The unfixed toner image before the fixing process for the fixed image of the reference pattern which is formed on the record medium and to be measured by the fixed image measuring means is identical with the fixed image of the reference pattern. Before the measurement of the fixed image, the unfixed toner image before the fixing process for the fixed image is measured by the toner image measuring means. At the same time when the image quality is controlled by the image quality controlling means, therefore, a change of the sensitivity of the toner image measuring means due to differences among apparatuses, a temporal change, or a change of the environment is calibrated by the sensitivity calibrating means.

Therefore, it is not required to output a test sheet frequently or at each time when the image management routine is to be conducted. As a result, the image quality can be controlled at high accuracy without causing the running cost to be increased and the original productivity of the image formation of the apparatus to be lowered.

The second aspect of the invention is directed to a control system which is used in the case where the environment is expected to be changed at a certain degree or where the image forming means is easily affected by a change of the environment. In the image forming apparatus of the second aspect of the invention, usually, an unfixed toner image of the reference pattern is formed by the image forming means, the unfixed toner image is measured by the toner image measuring means, the amount of supplied toner is controlled by the toner supply controlling means on the basis of the output of the toner image measuring means, and an operation amount of the image forming means such as the charge amount or the exposure value is controlled by the image quality controlling means on the basis of the output of the toner image measuring means, thereby maintaining the image quality constant.

The state amount detecting means detects a state amount relating to the image formation, such as the temperature or the humidity. If the image formation controlling means judges from the result of the detection of the state amount that there is a fear that the image quality exceeds the allowable range as a result of a change of the sensitivity of the toner image measuring means or the like, a fixed image of the reference pattern is formed on a record medium by the image forming means.

The fixed image of the reference pattern on the record medium is measured by the fixed image measuring means. The unfixed toner image before the fixing process for the fixed image of the reference pattern which is formed on the record medium is identical with the fixed image of the reference pattern. Before the measurement of the fixed image, the unfixed toner image before the fixing process for the fixed image is measured by the toner image measuring means. Therefore, a change of the sensitivity of the toner image measuring means due to differences among apparatuses, a temporal change, or a change of the environment is calibrated by the sensitivity calibrating means.

Therefore, it is not required to output a test sheet frequently or at each time when the image management routine is to be conducted. As a result, the image quality can be controlled at high accuracy without causing the running cost to be increased and the original productivity of the image formation of the apparatus to be lowered.

The above and other objects and features of the present invention will be more apparent from the following description taken in conjunction with the accompanying drawings.

BRIEF DESCRIPTION OF THE DRAWINGS

FIG. 15 is a view illustrating a state amount, an operation amount, and a control amount of the embodiment of FIG. 13.

DETAILED DESCRIPTION OF THE PREFERRED EMBODIMENTS

Now, a description will be given in more detail of preferred embodiments of the invention with reference to the accompanying drawings.

Embodiment 1

Figure 1:
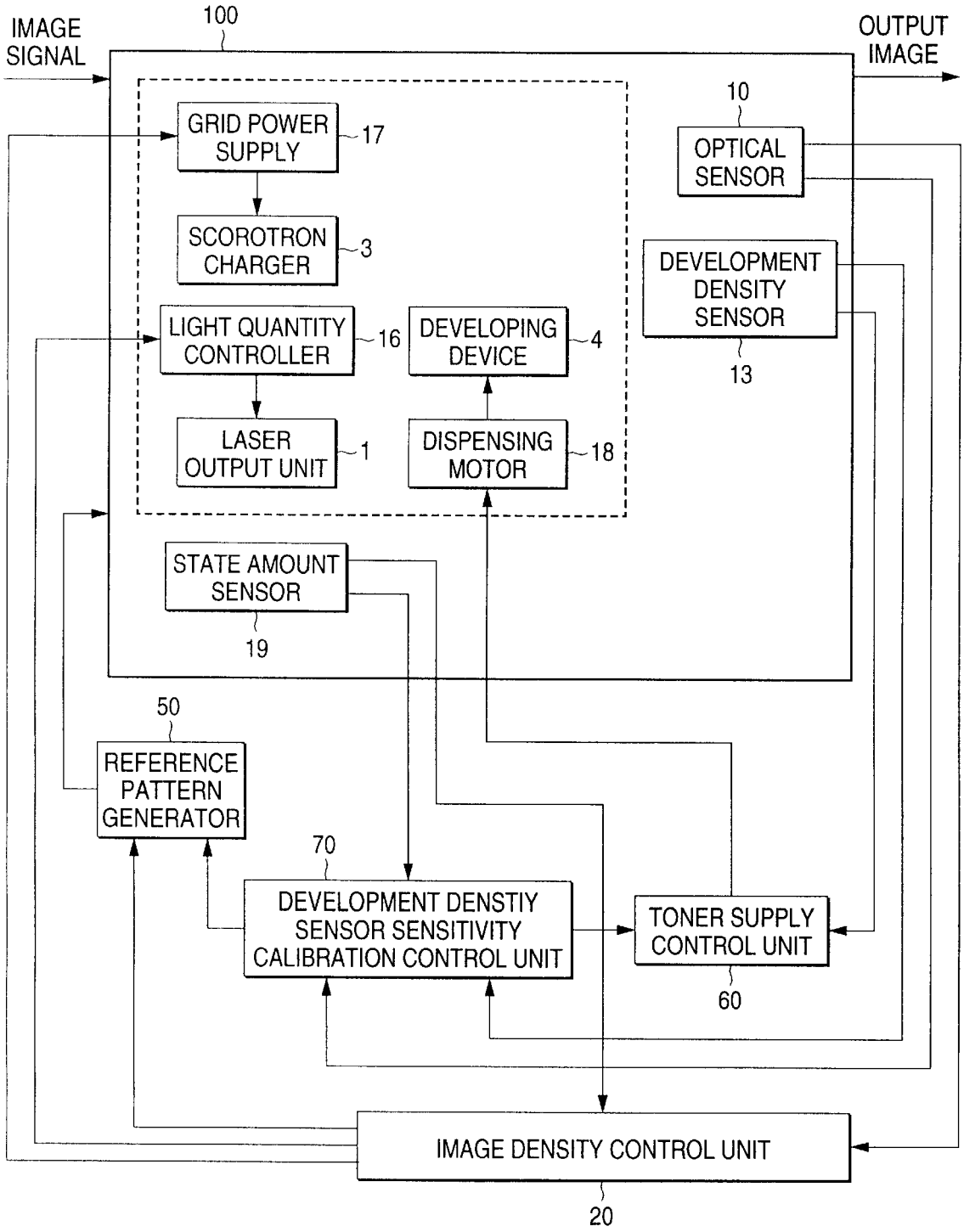
FIG. 1 is a view showing an image output unit and various control units of a first embodiment of the image forming apparatus of the invention.
Figure 2:
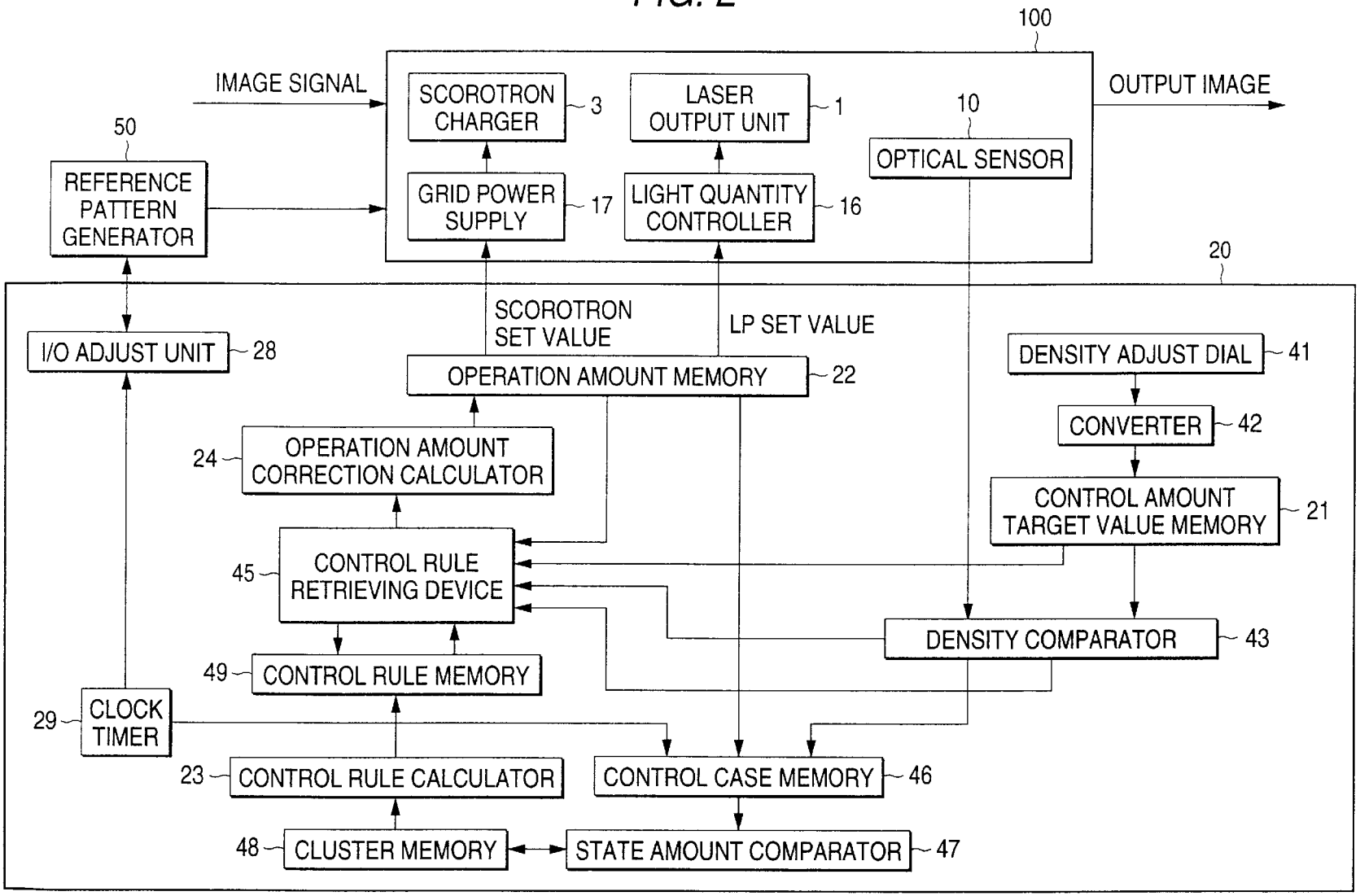
FIG. 2 is a view showing a specific example of an image density control unit of the embodiment of FIG. 1.

First, an example of the invention will be described as Embodiment 1. FIG. 1 shows an image output unit and various control units of an image forming apparatus of Embodiment 1, and FIG. 2 shows particularly a specific example of an image density control unit.

(Configuration of Embodiment 1)

(Image output unit)

Figures 3, 4:
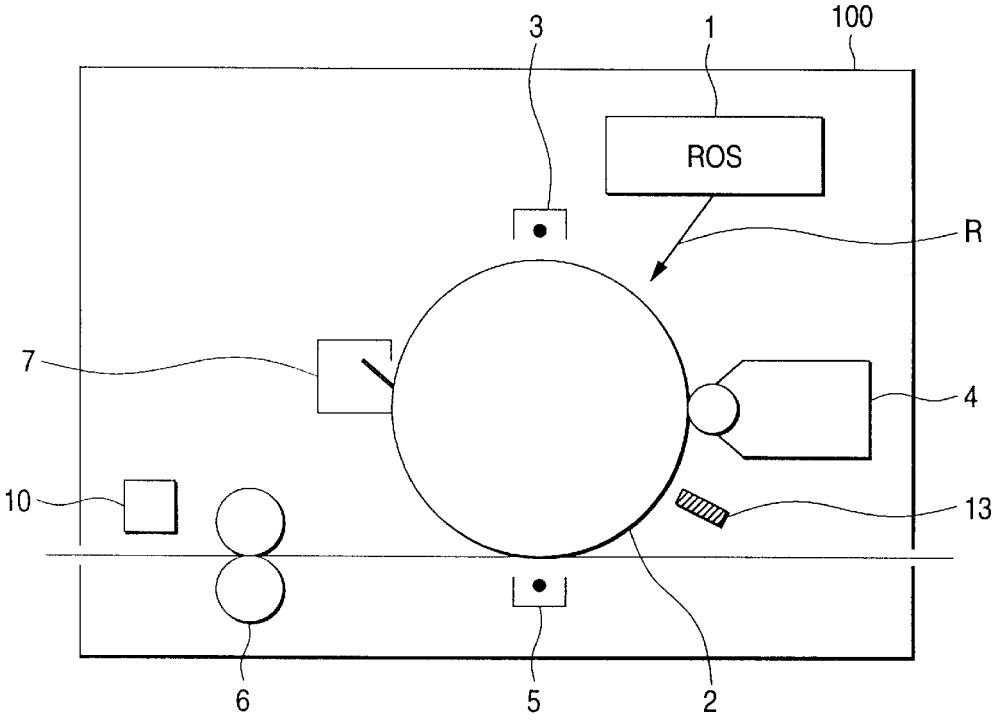
FIG. 3 is a view illustrating a state amount, an operation amount, and a control amount of the embodiment of FIG. 1.
FIG. 4 is a view showing an example of an image output unit of the image forming apparatus of the invention.

FIG. 4 schematically shows the image output unit of the image forming apparatus of Embodiment 1. In an image input unit which is not shown in the figure, an image of an original is read by a scanner to obtain input image data, or input image data which are prepared by an external computer are fetched into the apparatus. In an image process unit which also is not shown in the figure, necessary processing including color conversion and gray scale correction is conducted on the input image data from the image input unit and output image data which are to be output from the image output unit 100 are obtained.

In the image output unit 100, the output image data from the image process unit are converted by a screen generator which is not shown in the figure, into a laser on/off signal in which the pulse width is modulated in accordance with the pixel value. A laser diode of a laser output unit 1 is driven by the laser on/off signal, so that a laser beam R which is modulated with an image signal is obtained from the laser output unit 1. A photosensitive member 2 is irradiated with the laser beam R.

The photosensitive member 2 is uniformly charged by a scorotron charger 3. An electrostatic latent image is formed on the photosensitive member 2 by irradiating it with the laser beam R. A developing roll of a developing device 4 is abutted against the photosensitive member 2 on which the electrostatic latent image is formed, thereby developing the electrostatic latent image into a toner image.

The toner image on the photosensitive member 2 is transferred onto a sheet by a transfer device 5. The toner image on the sheet is fixed by a fixing device 6. After the toner image is transferred onto the sheet, the photosensitive member 2 is cleaned by a cleaner 7 thereby completing one image forming process.

The image output unit 100 outputs a banner sheet in order to provide information such as the title of the output document, and the output time, the difference of the used font, and an error in the sheet size. Also when the apparatus is powered on or manually set up by the user, a banner sheet is output.

The manual setup operation by the user can be selected through a mode changeover switch disposed in a user interface (not shown) of the image forming apparatus. When the manual setup mode is selected through the mode changeover switch, a banner sheet is output immediately before the output of a document which the user intends to output, and the apparatus is then set up.

The image output unit 100 comprises an optical sensor 10 disposed at a position downstream from the fixing device 6. The optical sensor measures a fixed image of a reference pattern for controlling the image quality which will be described later. A development density sensor, that is, a developed image sensor 13 which measures an unfixed toner image formed on the photosensitive member 2 is disposed so as to oppose the photosensitive member 2. The unfixed toner image is an image of a reference pattern for controlling the toner supply which will be described later.

As shown in FIG. 1, the image output unit 100 further comprises a light quantity controller 16 which controls the light quantity of the laser beam emitted from the laser output unit 1, a grid power supply 17 for the scorotron charger 3, and a dispensing motor 18 which controls the toner supply to the developing device 4.

(Reference pattern of a fixed image, and a preparing mechanism and a monitor mechanism for the pattern)

Figure 5:
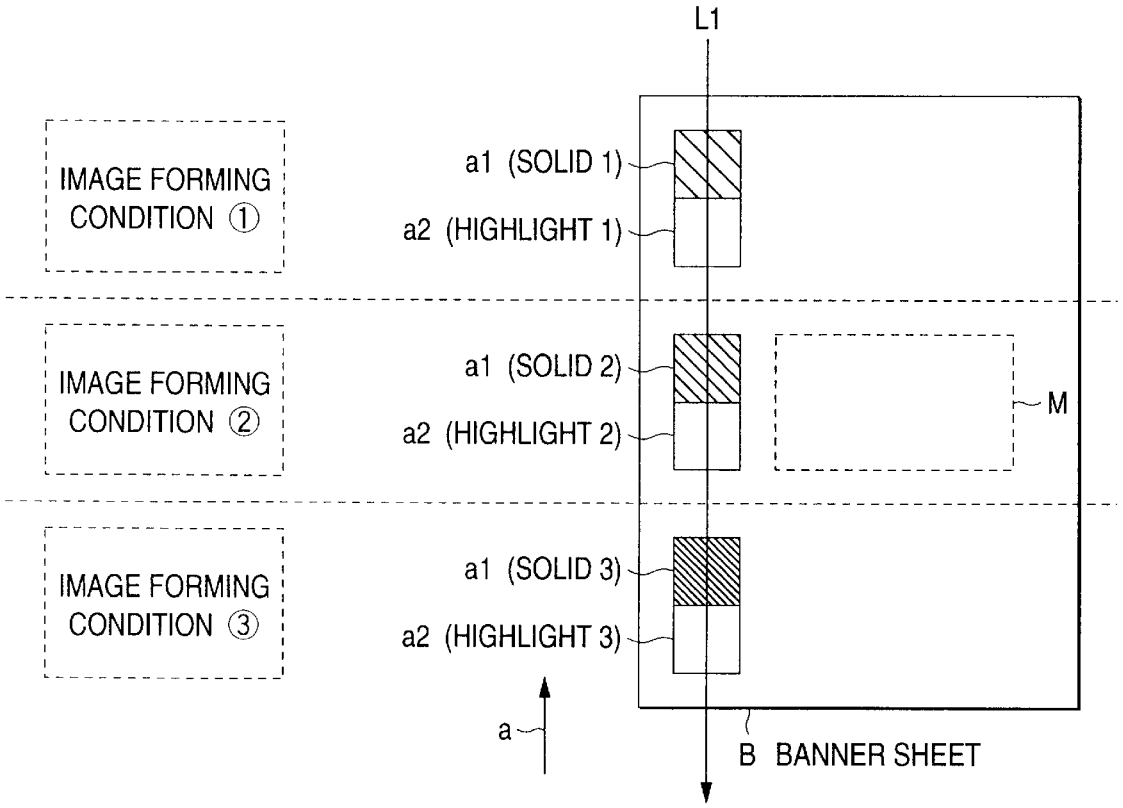
FIG. 5 is a view showing an example of a reference pattern of a fixed image.

As a reference pattern which is to be formed as a fixed image on a banner sheet, two kinds of patches, i.e., a solid (dot coverage ratio: 100%) density patch al and a highlight (dot coverage ratio: 20%) density patch a2 are used as shown in FIG. 5.

Each of the solid density patch a1 and the highlight density patch a2 is set to have a size of about 2 to 3 cm square. The patches are formed so as to be arranged in a direction opposite to the feeding direction (indicated by the arrow a) of the banner sheet B, and at positions on a line L1 which is outside a message region M of the banner sheet, while two kinds of operation amount set values are changed in three kinds of manners as described later.

Figure 7:
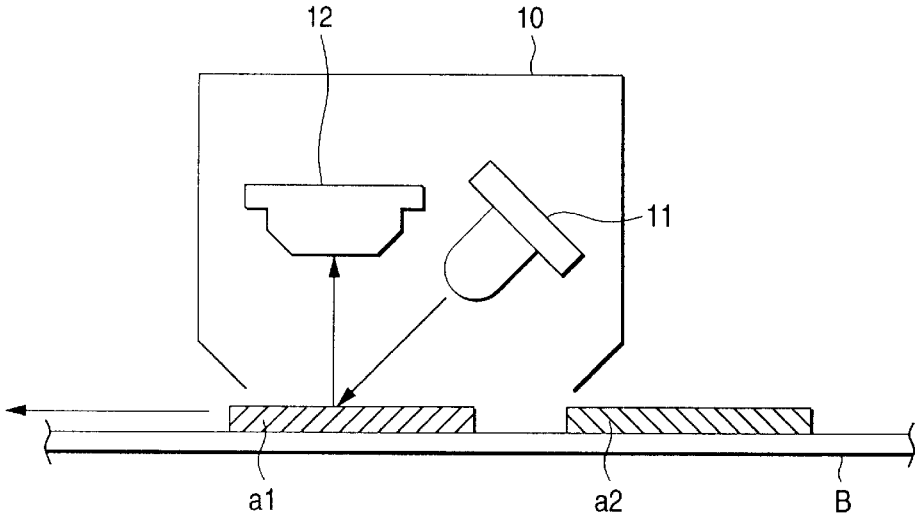
FIG. 7 is a view showing an example of the optical sensor.

As shown in FIG. 7, the optical sensor 10 which measures the reference pattern formed as a fixed image on the banner sheet B, i.e., the solid density patch a1 and the highlight density patch a2 is configured by an LED irradiation unit 11 which irradiates the banner sheet B with visible light, and a light receiving device 12 which receives light reflected from the banner sheet B. Specifically, the light receiving device 12 is a photodiode.

Figure 6:
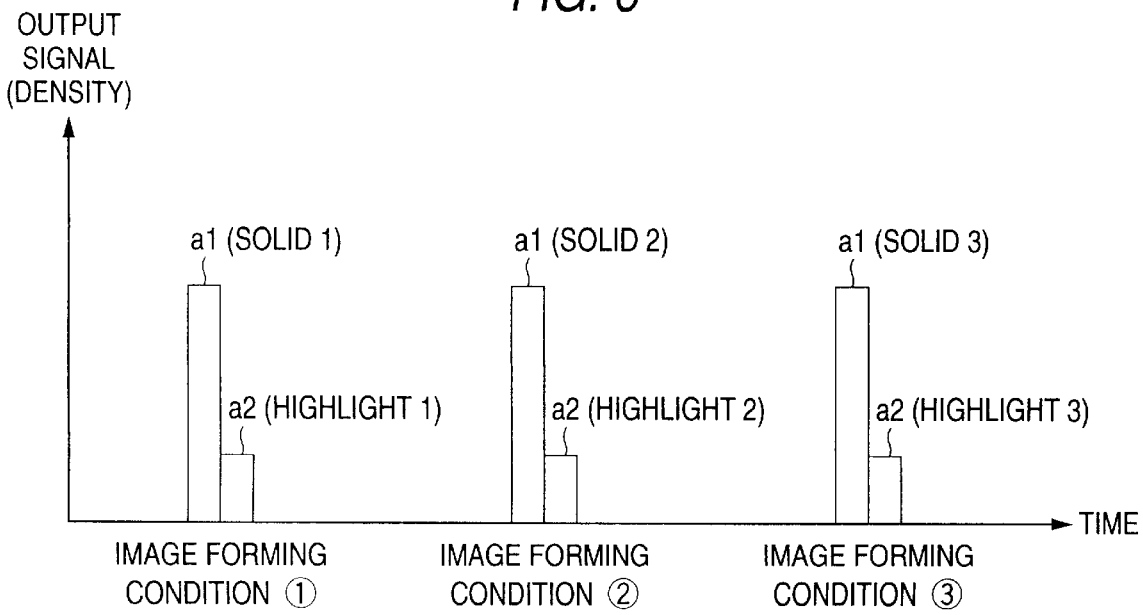
FIG. 6 is a view showing an example of an output signal of an optical sensor.

As shown in FIG. 6, therefore, the optical sensor 10, i.e., the light receiving device 12 outputs a signal which corresponds to the three kinds of combinations of the solid density patch a1 and the highlight density patch a2.

The image output unit 100 shown in FIG. 4 is used in a monochrome image forming apparatus. In the case of a color image forming apparatus which forms an image by using color toners of yellow, magenta, cyan, and black, a reference pattern such as that shown in FIG. 5 or a combination of the solid density patch a1 and the highlight density patch a2 is formed for each of yellow, magenta, cyan, and black, and the optical sensor 10 is disposed for each of the colors.

Figure 8:
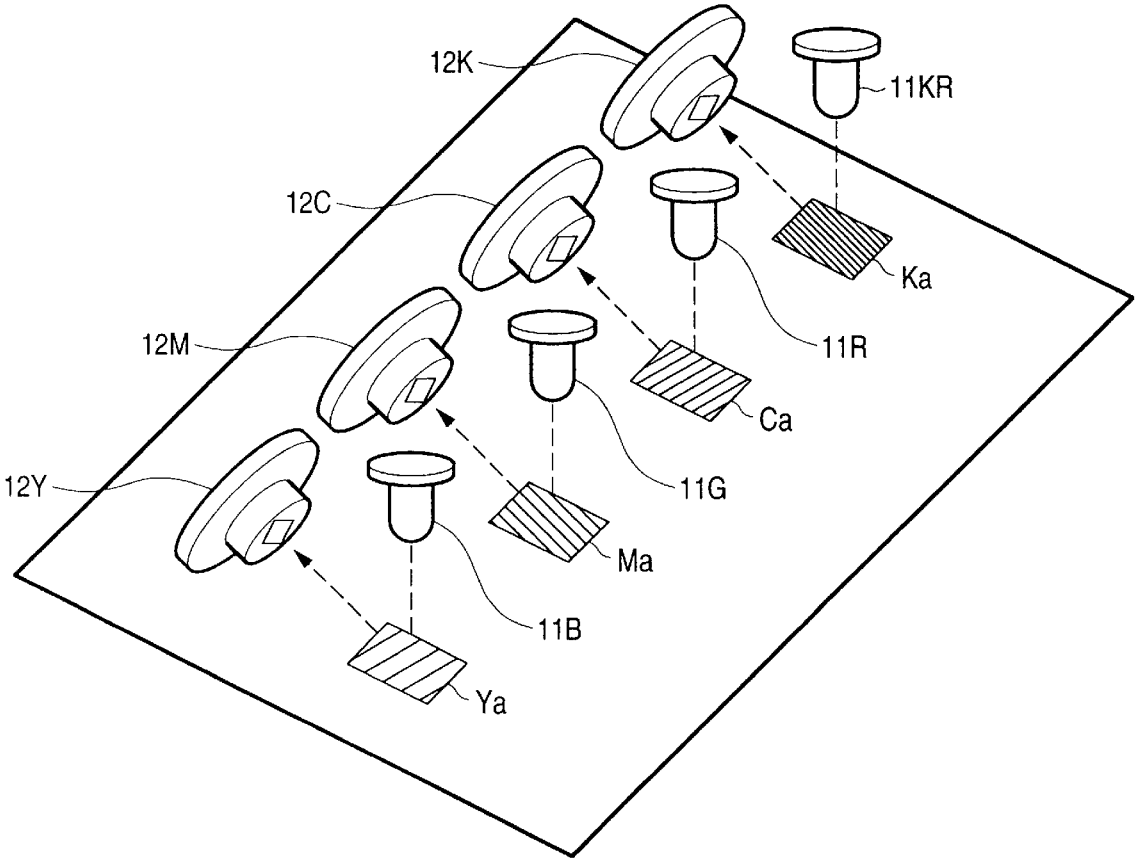
FIG. 8 is a view showing a further specific example of the optical sensor.

In this case, as shown in FIG. 8, for example, the optical sensor which measures a yellow density patch Ya is configured by an LED 11B irradiating the density patch Ya with light of blue which is the complementary color of yellow, and a light receiving device 12Y which receives light reflected from the density patch Ya; the optical sensor which measures a magenta density patch Ma is configured by an LED 11G irradiating the density patch Ma with light of green which is the complementary color of magenta, and a light receiving device 12M which receives light reflected from the density patch Ma; and the optical sensor which measures a cyan density patch Ca is configured by an LED 11R irradiating the density patch Ca with light of red which is the complementary color of cyan, and a light receiving device 12C which receives light reflected from the density patch Ca and a light receiving device 12K receives light from a density patch Ka.

Figure 9A:
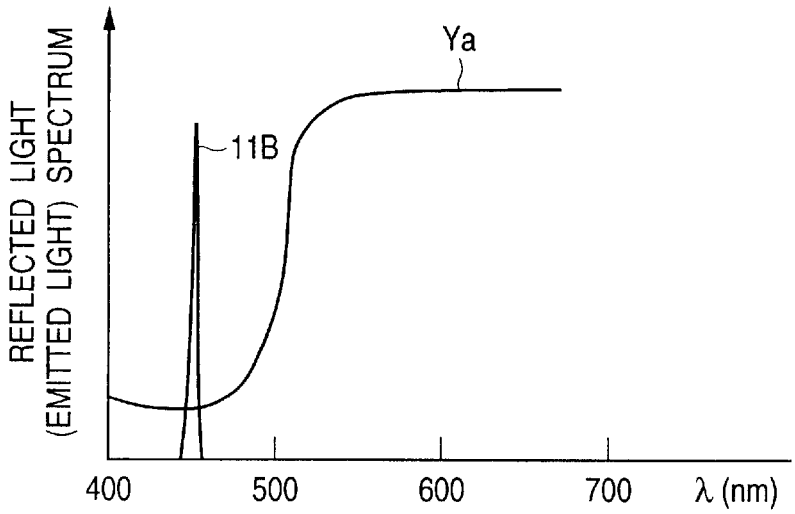
FIGS. 9A to 9C are graphs representing relationships between the emission spectra of the LEDs and the reflection spectra of the density patches, respectively.
Figure 9B:
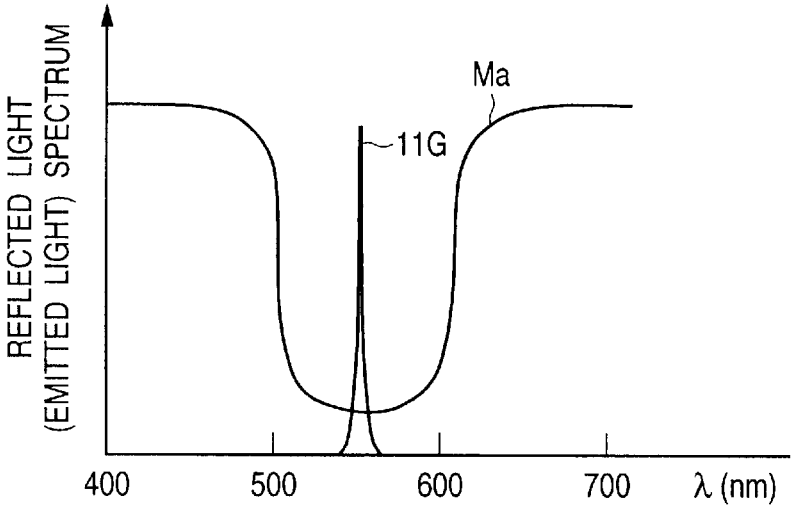
Figure 9C:
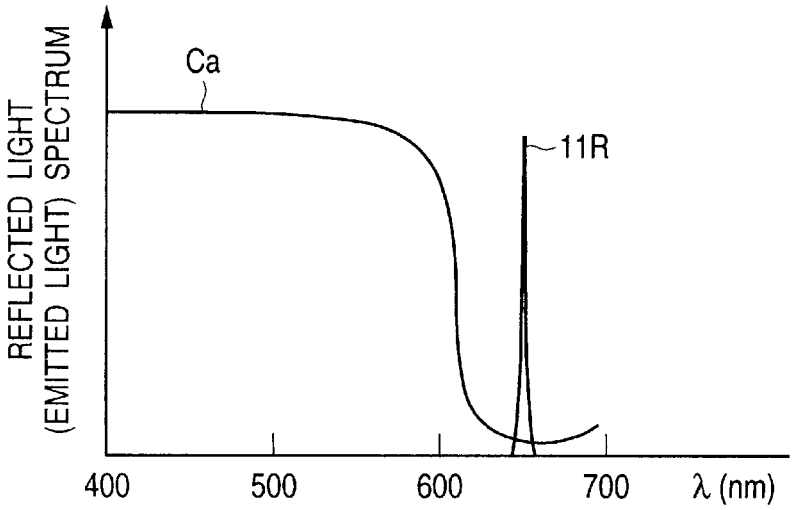

According to this configuration, relationships between the emission spectra of the LEDs 11B, 11G, and 11R and the reflection spectra of the density patches Ya, Ma, and Ca are as shown in FIGS. 9A, 9B and 9C, respectively, and detection accuracies of the yellow, magenta, and cyan density patches Ya, Ma, and Ca are improved.

In principle, an LED 11KR which illuminates a black density patch Ka shown in FIG. 8 may emit light of any one of blue, green, red, and white. In the example of FIG. 8, an LED which has a high light sensitivity, which is relatively economical, and which emits red light is used.

(Reference pattern of an unfixed toner image, and a preparing mechanism and a monitor mechanism for the pattern)

Figure 10:
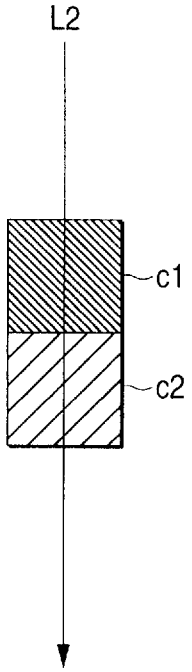
FIG. 10 is a view showing an example of a reference pattern of an unfixed toner image.

As a reference pattern which is to be formed as an unfixed toner image on the photosensitive member 2 shown in FIG. 4, two kinds of patches, i.e., a solid (dot coverage ratio: 100%) density patch c1 and a highlight (dot coverage ratio: 20%) density patch c2 are used as shown in FIG. 10.

Each of the solid density patch c1 and the highlight density patch c2 is set to have a size of about 2 to 3 cm square. After an output image is formed in an image area 2*a* of the photosensitive member 2 shown in FIG. 11, the patches are sequentially formed at positions on a line L2 in an idle area 2*b* of the photosensitive member 2.

Figure 12:
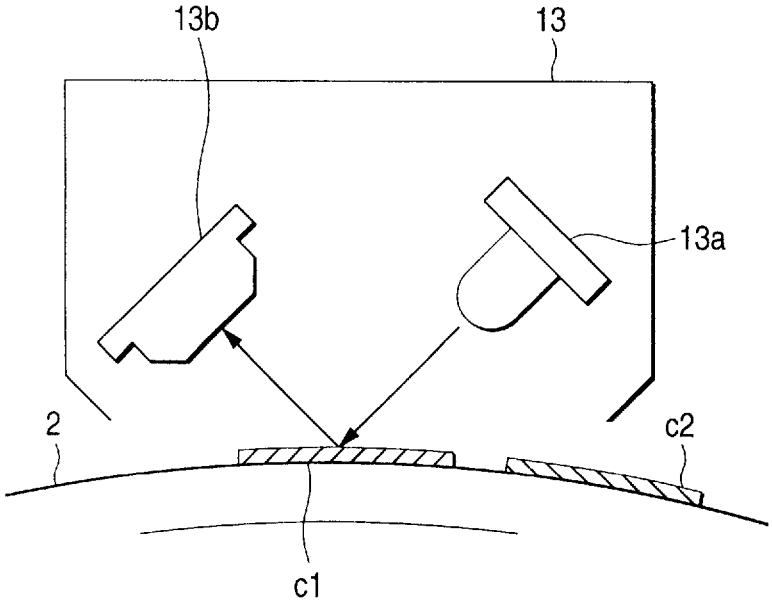
FIG. 12 is a view showing an example of a development density sensor.

As shown in FIG. 12, the development density sensor 13 which measures the reference pattern formed as an unfixed toner image on the photosensitive member 2, i.e., the solid density patch c1 and the highlight density patch c2 is configured by an LED irradiation unit 13*a* which irradiates the photosensitive member 2 with infrared rays, and a light receiving device 13*b* which receives regular reflected light or diffused light from the photosensitive member 2. Specifically, the light receiving device 13*b* is a photodiode.

Since the solid density patch c1 and the highlight density patch c2 are formed in the idle area 2*b* of the photosensitive member 2, the patches are not transferred to the sheet after the patches are measured by the development density sensor 13. When the patches pass through the cleaner 7 shown in FIG. 4, the patches are erased.

When the reference pattern formed as an unfixed toner image on the photosensitive member 2, i.e., the solid density patch c1 and the highlight density patch c2 are formed in a process other than the image formation, the patches may be formed in the image area 2*a* of the photosensitive member 2.

(State amount monitor mechanism)

As shown in FIG. 1, the image output unit 100 is provided with a state amount sensor 19 which detects state amounts relating to the image formation. Specifically, the state amount sensor 19 consists of a temperature sensor and a humidity sensor which respectively measure the temperature and the humidity of the image output unit 100.

In the embodiment, as further state amounts relating to the image formation, the number of sheets which are output after the previous calibration, and the operating time period of the apparatus elapsed after the previous calibration are detected by an output number counter and an operating time period counter, respectively. The output number counter and the operating time period counter are not required to be disposed in the image output unit 100. For the sake of convenience, however, also the output number counter and the operating time period counter will be described as parts of the state amount sensor 19.

(Reference pattern generator)

The image forming apparatus comprises a reference pattern generator 50 which generates a reference pattern signal for forming the reference pattern as a fixed image and the reference pattern as an unfixed toner image. As described later, the reference pattern generator 50 generates the reference pattern signal in response to instructions from a development density sensor sensitivity calibration control unit 70 and an image density control unit 20, and supplies the signal to the image output unit 100.

(Toner supply control unit and the development density sensor sensitivity calibration control unit)

A toner supply control unit 60 drives the dispensing motor 18 on the basis of the output of the development density sensor 13, i.e., the measurement output of the unfixed toner image of the reference pattern, thereby controlling the amount of toner supplied to the developing device 4. The development density sensor sensitivity calibration control unit 70 calibrates the sensitivity of the development density sensor 13 on the basis of the outputs of the state amount sensor 19, the development density sensor 13, and the optical sensor 10. These units will be described in detail later.

(Image density control unit)

In Embodiment 1, the image density control unit 20 controls operation amounts of the image output unit 100, or, in the embodiment, the grid voltage of the scorotron charger 3 and the laser output power of the laser output unit 1, on the basis of the output of the optical sensor 10, i.e., the measurement output of the fixed image of the reference pattern, thereby controlling the quality of the output image. For example, the image density control unit is configured as shown in FIG. 2.

Through a density adjust dial 41 of the image density control unit 20, the user presets target densities for the solid density patch a1 and the highlight density patch a2. The set values of the target densities of the density adjust dial 41 are converted by a converter 42 into values corresponding to output values of the optical sensor 10. The converted output values are stored in a control amount target value memory 21. In the embodiment, the converted output values are in the range of 0 to 255. The control amount target value memory 21 stores also allowable error values.

A density comparator 43 compares the measured value of the optical sensor 10 with the value of the target density of the output stored in the control amount target value memory 21. If the difference between the values is within the allowable error stored in the control amount target value memory 21, the output signal of the optical sensor 10 is supplied to a control rule retrieving device 45 through the density comparator 43. If the difference between the values is larger than the allowable error, the output signal of the optical sensor 10 is supplied to a control case memory 46 through the density comparator 43.

The control case memory 46 is a memory which stores control cases, and, specifically, stores sets of three kinds of amounts, the state amount, the operation amount, and the control amount. Control cases are stored in this way because, in the embodiment, various controls are conducted on the basis of control cases which are previously stored. This is a control method based on the technique which is called the case-based reasoning.

The state amounts stored in the control case memory 46 include the temperature and the humidity which dominantly affect the electrophotographic process, and the amount of temporal deterioration. In the embodiment, the state amounts are the temperature, the humidity, the number of output sheets, and the operating time period which are detected by the state amount sensor 19 shown in FIG. 1. These state amounts can be assumed to be constant for a certain time period. Therefore, the occurrence time (year, month, day, hour, minute, and second) of each case is used in place of the state amounts.

When occurrence times are within a predetermined unit time period such as 3 minutes, 5 minutes, or 10 minutes, they are treated as identical state amounts. This is conducted because it is expected that cases of similar occurrence times are substantially equal in temperature and humidity and have a similar degree of temporal deterioration. In the embodiment, a time data indicating the occurrence time of a case is supplied from a clock timer 29 to the control case memory 46.

The operation amount is an adjusting amount of a parameter for changing the output value of an object to be controlled. In the embodiment, as described above, two kinds of operation amounts, i.e., a set value of the grid voltage of the scorotron charger 3 (hereinafter, referred to as "scorotron set value") and a set value of the laser output power of the laser output unit 1 (hereinafter, referred to as "LP set value") are used. The two values are used as operation amounts because the final image density to be controlled is in two portions or a solid density portion and a highlight density portion, and the scorotron set value and the LP set value are highly correlated with each other in solid density and highlight density. The scorotron set value and the LP set value are in the range of 0 to 255.

The scorotron set value and the LP set value are stored in an operation amount memory 22, and values corresponding to an output signal of an operation amount correction calculator 24 are suitably read out from the memory.

The scorotron set value which is read out from the operation amount memory 22 is supplied to the grid power supply 17. In response to this, the grid power supply 17 applies a voltage corresponding to the scorotron set value, to the scorotron charger 3.

The LP set value which is read out from the operation amount memory 22 is supplied to the light quantity controller 16. In response to this, the light quantity controller 16 supplies a laser output power corresponding to the LP set value, to the laser output unit 1.

The control amount to be stored in the control case memory 46 is the output signal of the optical sensor 10 which is supplied through the density comparator 43 as described above, i.e., density detection signals for the three combinations of the solid density patch a1 and the highlight density patch a2.

As a result, control cases such as those listed in the table of FIG. 3 are stored in the control case memory 46. Specifically, in case 1 shown in FIG. 3, the state amount (case occurrence time) is zero minute ten seconds past twelve, Mar. 1, 1996, the scorotron set value is "130," the LP set value is "83," and the output value of the optical sensor 10 which is the control amount is "185" for the solid density patch a1 and "23" for the highlight density patch a2. In cases 1 to 3, the case occurrence times which serve as the state amount are identical with each other in order that three cases are fetched from the output of one banner sheet B.

A state amount comparator 47, a cluster memory 48, and a control rule calculator 23 of the image density control unit 20 shown in FIG. 2 have a function of extracting a control rule with referring the control cases stored in the control case memory 46.

A control rule memory 49 is a memory which stores plural control rules calculated by the control rule calculator 23. When the memory receives a request from the control rule retrieving device 45, the memory sends a control rule corresponding to the request to the control rule retrieving device 45. In this case, the control rule retrieving device 45 requests the control rule memory 49 to send a control rule corresponding to the difference between the measured value of the optical sensor 10 and the value of the target density from the control amount target value memory 21 and supplied from the density comparator 43, and also to the operation amount supplied from the operation amount memory 22, i.e., the scorotron set value and the LP set value.

The operation amount correction calculator 24 calculates a correction value of the operation amount by using the control rule retrieved by the control rule retrieving device 45, and supplies the calculated correction value to the operation amount memory 22. This causes the operation amount memory 22 to supply an operation amount corresponding to the operation amount correction value, i.e., the scorotron set value and the LP set value, to the grid power supply 17 and the light quantity controller 16, respectively.

In the control of the image density which is conducted by the image density control unit 20, at the timing when the reference pattern is formed during the output of a banner sheet, the reference pattern generator 50 supplies the signal of the reference pattern of the fixed image to the image output unit 100. As a result, the three combinations of the solid density patch a1 and the highlight density patch a2 are formed on the banner sheet B as shown in FIG. 5.

In this case, the operation timing of the reference pattern generator 50 is determined by an I/O adjust unit 28. During the banner sheet output, the I/O adjust unit 28 monitors a time signal output from the clock timer 29, and supplies an operation timing signal to the reference pattern generator 50 so that the solid density patch a1 and the highlight density patch a2 are formed at predetermined positions on the banner sheet B. The image density control unit 20 may be configured in any manner as far as it has the above-mentioned functions. For example, the unit may have the configuration disclosed in the specification of U.S. Pat. No. 5,682,573 issued on Oct. 28, 1997.

(Toner supply control)

Figure 11:
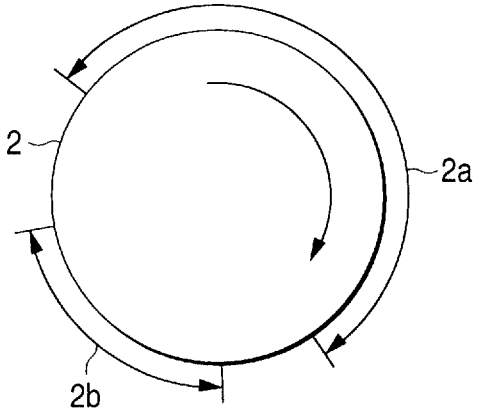
FIG. 11 is a view showing an image area and an idle area of a photosensitive member.

During the usual image formation, the reference pattern generator 50 supplies a signal of the reference pattern to the image output unit 100. As a result, the unfixed toner image of the solid density patch c1 and the highlight density patch c2 is formed in the idle area 2*b* of the photosensitive member 2 as shown in FIGS. 10 and 11.

The development density sensor 13 detects the amount of adhering toner per unit area of the unfixed toner image of the solid density patch c1 and the highlight density patch c2. The toner supply control unit 60 compares the detected value with the target value stored in the memory of the toner supply control unit 60. In accordance with the comparison result, toner is suppled to the developing device 4.

Specifically, the dispensing motor 18 is driven for a time period which is proportional to the difference between the measured density value of the solid density patch c1 and the target value of the solid density, so that toner of an amount proportional to the difference is suppled to the developing device 4. The proportional constant of the driving time period of the dispensing motor 18 with respect to the difference between the measured value of the solid density and the target value is previously determined from prior experiments.

(Calibration of the sensitivity of the development density sensor)

The sensitivity of the development density sensor 13 is calibrated by the development density sensor sensitivity calibration control unit 70 in response to instructions from a user interface (not shown) in the case such as that where the user or the engineer judges that such calibration is necessary or that where a part relating to the image formation is replaced with another one.

In the development density sensor sensitivity calibration control unit 70, the output of the state amount sensor 19, i.e., the temperature, the humidity, the number of sheets which are output after the previous calibration, and the operating time period elapsed after the previous calibration are compared with thresholds of the state amounts which are previously stored in the memory of the development density sensor sensitivity calibration control unit 70, respectively. If it is judged that the sensitivity of the development density sensor 13 must be calibrated, the development density sensor sensitivity calibration control unit 70 automatically conducts the sensitivity calibration on the development density sensor 13. In this case, the necessity of the sensitivity calibration may be judged on the basis of comparisons which are separately conducted on the respective state amounts, or combinations of the state amounts.

When the calibration of the sensitivity of the development density sensor 13 is conducted in response to instructions input through the user interface or a judgement of the development density sensor sensitivity calibration control unit 70, the development density sensor sensitivity calibration control unit 70 first instructs the reference pattern generator 50 to supply a signal of the reference pattern to the image output unit 100. Then, an unfixed toner image of the solid density patch c1 and the highlight density patch c2 such as that shown in FIG. 10 is formed in the image area 2*a* of the photosensitive member 2.

The unfixed toner image of the solid density patch c1 and the highlight density patch c2 is measured by the development density sensor 13. The measured value is written into the memory of the development density sensor sensitivity calibration control unit 70.

The unfixed toner image of the solid density patch c1 and the highlight density patch c2 in the image area 2*a* of the photosensitive member 2 is then transferred to the banner sheet by the transfer device 5 shown in FIG. 4. The transferred image is fixed by the fixing device 6 to be converted into a fixed image of the solid density patch c1 and the highlight density patch c2.

The fixed image of the solid density patch c1 and the highlight density patch c2 is measured by the optical sensor 10. The measured value is written into the memory of the development density sensor sensitivity calibration control unit 70.

In the development density sensor sensitivity calibration control unit 70, relationships among differences between the value of a fixed image measured by the optical sensor 10 and that of an unfixed toner image measured by the development density sensor 13, and coefficients for sensitivity calibration are previously written in the form of a LUT (Look-Up Table). The development density sensor sensitivity calibration control unit 70 obtains the difference between the value of the fixed image measured by the optical sensor 10 and that of the unfixed toner image measured by the development density sensor 13. A retrieval operation based on the difference is conducted on the LUT and a coefficient for sensitivity calibration is read. Also in this case, practically, only the solid density is used.

The read coefficient for sensitivity calibration is supplied to the toner supply control unit 60. In the toner supply control described above, the coefficient is multiplied with the proportional constant of the driving time period of the dispensing motor 18 with respect to the difference between the measured value of the solid density and the target value, in order that the sensitivity change of the development density sensor 13 is canceled.

(Effects of Embodiment 1)

According to Embodiment 1 described above, usually, the amount of supplied toner is controlled by the toner supply control unit 60 on the basis of an unfixed toner image of the reference pattern, thereby maintaining the image quality constant. Therefore, it is not required to output a test sheet frequently or at each time when the image management routine is to be conducted. As a result, the image quality can be controlled at high accuracy without causing the running cost to be increased and the original productivity of the image formation of the apparatus to be lowered.

(Modifications of Embodiment 1)

The reference pattern is not restricted to the two kinds of patches, i.e., the solid (dot coverage ratio: 100%) density patch and the highlight (dot coverage ratio: 20%) density patch. For example, only a density patch corresponding to a dot coverage ratio of 50% may be used. Alternatively, a larger number of kinds of density patches may be used so that a larger number of gray scale points are controlled.

When gray scale points are to be independently controlled, the number of kinds of control parameters must correspond to that of gray scale points.

In the embodiment, the development bias, the rotational speed of the developing roll, and the toner supply coefficient are set to be constant. Also the development bias, the rotational speed of the developing roll, and the toner supply coefficient are highly correlated with each other in solid density and highlight density. Therefore, two of the grid voltage of the scorotron charger, the laser output power, the development bias, the rotational speed of the developing roll, and the toner supply coefficient may be used as the control parameter or the operation amount.

Alternatively, three of the grid voltage of the scorotron charger, the laser output power, the development bias, the rotational speed of the developing roll, and the toner supply coefficient may be used, and three gray scale points, such as those for dot coverage ratios of 100%, 50%, and 20% may be controlled.

In the embodiment, the reference pattern of a fixed image is formed while changing the operation amount in three kinds of manners. Alternatively, the reference pattern of a fixed image may be formed while changing the operation amount in four or more kinds of manners. In the alternative, the control rule may be extracted as a plane from reading coordinates of the reference patterns by the method of least squares. In this case, effects due to measurement errors may be reduced by conducting a statistical averaging operation. Alternatively, the control rule may be extracted as a curved surface of second or higher order. In the alternative, the adaptability to the nonlinearity of a zero process is further enhanced.

In the above, the embodiment applied to a monochrome image forming apparatus has been described. Embodiment 1 may be applied also to a multicolor image forming apparatus in the strictly same manner, with attaining the same effects. The embodiment may be applied also to an analog copier.

As the optical sensor or density measuring means, for example, a CCD sensor or the like may be used.

Embodiment 2

Figure 13:
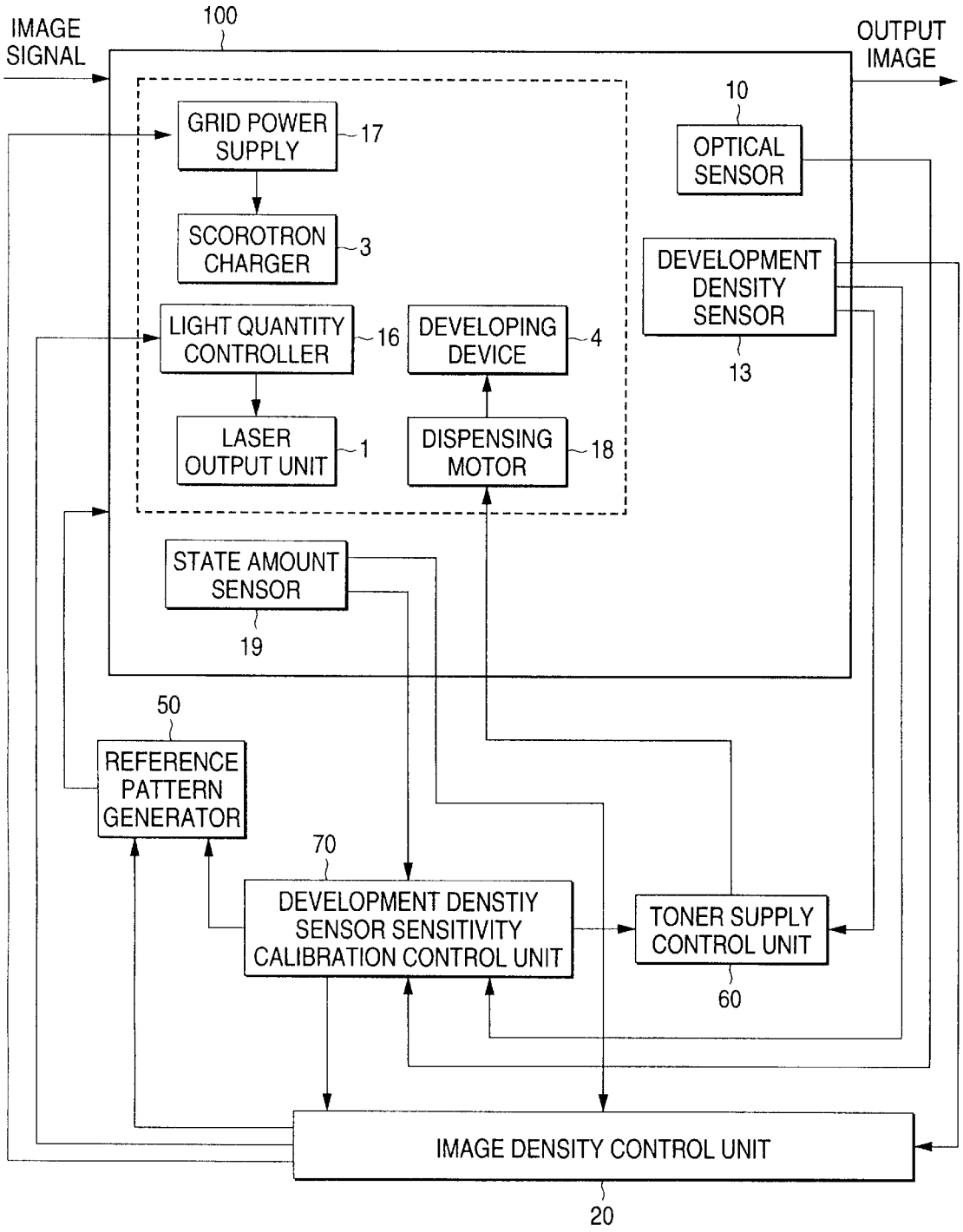
FIG. 13 is a view showing an image output unit and various control units of a second embodiment of the image forming apparatus of the invention.
Figure 14:
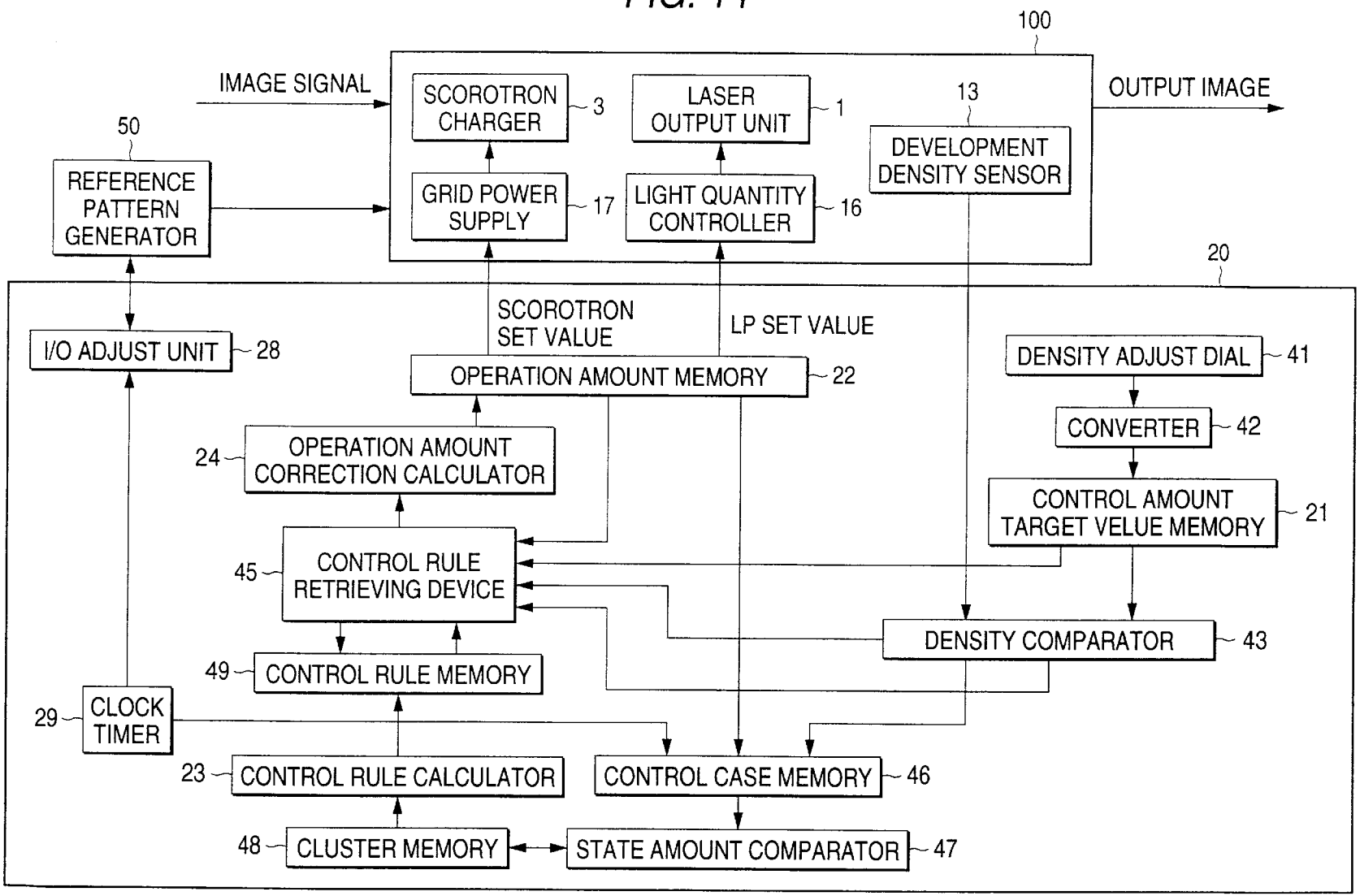
FIG. 14 is a view showing a specific example of an image density control unit of the embodiment of FIG. 13.

Next, an example of the invention set forth in claim 2 will be described as Embodiment 2. FIG. 13 shows an image output unit and various control units of an image forming apparatus of Embodiment 2, and FIG. 14 shows particularly a specific example of an image density control unit.

(Configuration of Embodiment 2)

(Image output unit)

The image output unit 100 of the image forming apparatus of Embodiment 2 is identical with that of Embodiment 1, and configured as shown in, for example, FIG. 4.

(Reference pattern of a fixed image, and a preparing mechanism and a monitor mechanism for the pattern)

(Reference pattern of an unfixed toner image, and a preparing mechanism and a monitor mechanism for the pattern)

(State amount monitor mechanism)

(Reference pattern generator)

Also the reference pattern of a fixed image, the preparing mechanism and the monitor mechanism for the pattern, the reference pattern of an unfixed toner image, the preparing mechanism and the monitor mechanism for the pattern, the state amount monitor mechanism, and the reference pattern generator 50 are identical with those of Embodiment 1.

(Toner supply control unit and the development density sensor sensitivity calibration control unit)

Also the toner supply control unit 60 and the development density sensor sensitivity calibration control unit 70 are identical with those of Embodiment 1. These units will be described in detail later.

(Image density control unit)

In Embodiment 2, the image density control unit 20 controls operation amounts of the image output unit 100, or, in the embodiment, the grid voltage of the scorotron charger 3 and the laser output power of the laser output unit 1, on the basis of the output of the development density sensor 13, i.e., the measurement output of the unfixed toner image of the reference pattern, thereby controlling the quality of the output image. Therefore, the embodiment is configured in the same manner as Embodiment 1 except that the formation and measurement of the reference pattern of a fixed image on the banner sheet B in Embodiment 1 are replaced with those of the reference pattern of an unfixed toner image on the photosensitive member 2.

Control cases such as those listed in the table of FIG. 15 are stored in the control case memory 46 of the image density control unit 20. The control cases are different from those of Embodiment 1 only in that the output value of the optical sensor 10 shown in FIG. 3 is replaced with that of the development density sensor 13.

(Operation of Embodiment 2)

(Operation of initializing the image density control unit)

Also in the image forming apparatus of Embodiment 2, as an initializing process or a so-called function start up process, the engineer suitably sets the scorotron set value and the LP set value of the control parameters. The image density control unit 20 forms the solid density patch c1 and the highlight density patch c2 on the photosensitive member 2. Each of the patches is measured by the development density sensor 13, and the measurement result is stored as a control case in the control case memory 46. As a result, a first control case is stored in the control case memory 46.

Similarly, further two control cases are stored in the control case memory 46 while changing the scorotron set value and the LP set value. In other words, in the same manner as Embodiment 1, three control cases in total for the function start up process, and unit time periods in which the state amount is identical are stored in the control case memory 46.

The three control cases are combinations which are selected so that the scorotron set values and the LP set values are not arranged in a straight line in a plane formed by a scorotron set value axis and an LP set value axis. The reason why three cases are used is the same as that of Embodiment 1. It is a matter of course that a larger number of control cases may be used.

When the three control cases for the initializing process are stored in the control case memory 46 as described above, the stored contents are supplied to the control rule calculator 23 through the state amount comparator 47 and the cluster memory 48, and a control rule is calculated by the control rule calculator 23. In this case, the control rule is extracted as a control case plane.

(Basic operation of the image density control unit during a working period)

Regarding a working period of the image forming apparatus, hereinafter, a case where a control rule of initial setting is determined as described above and a control for a real work is started on the next day is supposed.

When the image forming apparatus is powered on, a set up operation is automatically executed. In the set up operation, the solid density patch c1 and the highlight density patch c2 are formed on the photosensitive member 2 while using the previous set values, for example, the set values of the final image output of the previous day as the present set values, and then measured by the development density sensor 13. The measured values are plotted in the control case space.

It is assumed that the scorotron set value is "76," the LP set value is "98," and the densities of the solid density patch c1 and the highlight density patch c2 detected by the development density sensor 13 are B4 and H4, respectively. Then, the present control contents corresponding to the stored control case are recognized.

The plotting operation is conducted by the control rule retrieving device 45 shown in FIG. 14. Specifically, the control rule retrieving device 45 plots the measured density values B4 and H4 transferred from the development density sensor 13 through the density comparator 43, in the control case plane for the initial setting operation and stored in the control rule memory 49, on the basis of the scorotron set value of "76" and the LP set value of "98" transferred from the operation amount memory 22.

The control case plane is a plane which is formed by plotting output values at certain setting under a certain state. When the state is changed in any way and a different output value is obtained under the same setting, therefore, the control case plane does not naturally coincide with that under the state before the change occurs.

In other words, when the control contents of the present set up operation are plotted "without being effectively separated by a distance" in the control case plane which is formed in the start operation of the previous day, this means that effects of all factors in the start operation which may affect the electrophotographic process, such as the temperature, the humidity, and the degree of the temporal change can be deemed to be substantially identical with those in the present operation. The terms "without being effectively separated by a distance" means a case where, when the control is conducted while assuming that coincidence is attained in the control case plane, the difference between the density of an actually output image and the target density is not larger than the allowable error.

Next, the target density which is set by the user through the density adjust dial 41 is converted into values corresponding to an output value of the development density sensor 13, and then set as a target density plane in the control case space.

Specifically, the target density set value of the density adjust dial 41 is converted by the converter 42 into values corresponding to an output value of the development density sensor 13. The converted output value is stored in the control amount target value memory 21. Then, the value is read out from the control amount target value memory 21, and transferred to the control rule retrieving device 45.

The control rule retrieving device 45 describes the target density in the control rule case, as a target density plane which is parallel with a plane formed by the scorotron set value axis and the LP set value axis, and superposes it on a solid case plane BP and a highlight case plane HP which are read out from the control rule memory 49.

As a result, in the control case space, the solid case plane BP, the highlight case plane HP, a solid target density plane BTP, and a highlight target density plane HTP are formed, and the control contents of the present set up operation are plotted.

(Calibration of the sensitivity of the development density sensor)

The sensitivity of the development density sensor 13 is calibrated by the development density sensor sensitivity calibration control unit 70 in response to instructions from a user interface (not shown) in the case such as that where the user or the engineer judges that such calibration is necessary or that where a part relating to the image formation is replaced with another one.

In the development density sensor sensitivity calibration control unit 70, the output of the state amount sensor 19, i.e., the temperature, the humidity, the number of sheets which are output after the previous calibration, and the operating time period elapsed after the previous calibration are compared with thresholds of the state amounts which are previously stored in the memory of the development density sensor sensitivity calibration control unit 70, respectively. If it is judged that the sensitivity of the development density sensor 13 must be calibrated, the development density sensor sensitivity calibration control unit 70 automatically conducts the sensitivity calibration on the development density sensor 13. In this case, the necessity of the sensitivity calibration may be judged on the basis of comparisons which are separately conducted on the respective state amounts, or combinations of the state amounts.

When the calibration of the sensitivity of the development density sensor 13 is conducted in response to instructions input through the user interface or a judgement of the development density sensor sensitivity calibration control unit 70, the development density sensor sensitivity calibration control unit 70 first instructs the reference pattern generator 50 to supply a signal of the reference pattern to the image output unit 100. Then, an unfixed toner image of the solid density patch c1 and the highlight density patch c2 such as that shown in FIG. 10 is formed in the image area 2*a* of the photosensitive member 2.

The unfixed toner image of the solid density patch c1 and the highlight density patch c2 is measured by the development density sensor 13. The measured value is written into the memory of the development density sensor sensitivity calibration control unit 70.

The unfixed toner image of the solid density patch c1 and the highlight density patch c2 in the image area 2*a* of the photosensitive member 2 is then transferred to the banner sheet by the transfer device 5 shown in FIG. 4. The transferred image is fixed by the fixing device 6 to be converted into a fixed image of the solid density patch c1 and the highlight density patch c2.

The fixed image of the solid density patch c1 and the highlight density patch c2 is measured by the optical sensor 10. The measured value is written into the memory of the development density sensor sensitivity calibration control unit 70.

In the development density sensor sensitivity calibration control unit 70, relationships among differences between the value of a fixed image measured by the optical sensor 10 and that of an unfixed toner image measured by the development density sensor 13, and coefficients for sensitivity calibration are previously written in the form of a LUT (Look-Up Table). The development density sensor sensitivity calibration control unit 70 obtains the difference between the value of the fixed image measured by the optical sensor 10 and that of the unfixed toner image measured by the development density sensor 13. A retrieval operation based on the difference is conducted on the LUT and a coefficient for sensitivity calibration is read. Also in this case, practically, only the solid density is used.

The read coefficient for sensitivity calibration is supplied to the toner supply control unit 60. In the toner supply control described above, the coefficient is multiplied with the proportional constant of the driving time period of the dispensing motor 18 with respect to the difference between the measured value of the solid density and the target value, in order that the sensitivity change of the development density sensor 13 is canceled.

(Effects of Embodiment 2)

According to Embodiment 2 described above, usually, the amount of supplied toner is controlled by the toner supply control unit 60 on the basis of an unfixed toner image of the reference pattern, and the operation amount of the image output unit 100 is controlled by the image density control unit 20, thereby maintaining the image quality constant. Therefore, it is not required to output a test sheet frequently or at each time when the image management routine is to be conducted. As a result, the image quality can be controlled at high accuracy without causing the running cost to be increased and the original productivity of the image formation of the apparatus to be lowered.

(Modifications of Embodiment 2)

Also Embodiment 2 may be variously modified in the strictly same manner as the modifications of Embodiment 1 described above.

As described above, according to the invention, even when a control is conducted while measuring a fixed imaged in order to improve total image accuracy, the frequency of outputting a test sheet for measurement can be lowered. Therefore, the running cost can be prevented from being increased, and the original productivity of the image formation of an apparatus can be prevented from being lowered. Even when the engineer does not previously know effects due to various environmental conditions and temporal deterioration, a control can be conducted at high accuracy, and hence development manhours can be reduced to a very low level. Even when a huge number of image forming apparatuses are produced and used in various manners and replacement of their parts is conducted as required, moreover, the control performance for image density of each of the apparatuses can be always automatically ensured. Furthermore, temporal change and an apparatus difference of the central value or the average value of the image quality can be controlled not in a relative manner but in an absolute manner by measuring the density of a fixed image which is the final output image.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

image forming means of an electrophotographic type;

toner image measuring means for measuring an unfixed toner image of a reference pattern, the unfixed toner image being formed by said image forming means;

toner supply controlling means for controlling an amount of supplied toner on the basis of an output of said toner image measuring means;

state amount detecting means for detecting a state amount relating to an image formation;

image formation controlling means for causing said image forming means to form a fixed image of the reference pattern on a record medium, on the basis of a detection result of said state amount detecting means;

fixed image measuring means for measuring the fixed image of the reference pattern, the fixed image being formed by said image forming means;

image quality controlling means for controlling a quality of an output image on the basis of an output of said fixed image measuring means; and sensitivity calibrating means for calibrating a sensitivity of said toner image measuring means on the basis of the output of said fixed image measuring means.

2. An image forming apparatus according to claim 1, wherein said toner image measuring means detects an amount of adhering toner of the unfixed toner image.

3. An image forming apparatus according to claim 1, wherein said toner image measuring means irradiates the unfixed toner image with infrared rays and detects a density of the unfixed toner image from a quantity of reflected light or a quantity of diffused light.

4. An image forming apparatus according to claim 1, wherein said fixed image measuring means detects a density of a single toner color on the record medium as the fixed image.

5. An image forming apparatus according to claim 1, wherein said fixed image measuring means detects a density of a single toner color among colors of yellow, magenta, cyan, and black on the record medium as the fixed image.

6. An image forming apparatus according to claim 1, wherein said fixed image measuring means detects a density of the fixed image while separating the fixed image into colors of red, green, and blue.

7. An image forming apparatus according to claim 1, wherein said fixed image measuring means irradiates the fixed image with light emitted from a light emitting diode and detects a density of the fixed image from a quantity of reflected light or a quantity of transmitted light.

8. An image forming apparatus according to claim 1, wherein said fixed image measuring means measures the fixed image and outputs an image signal in an L*a*b* color space, an L*C*h color space, or an XYZ color space.

9. An image forming apparatus according to claim 1, wherein said state amount detecting means detects one of a temperature, humidity, a number of sheets output by said image forming means, and an operating time period of said image forming apparatus.

10. An image forming apparatus according to claim 1, wherein said toner supply controlling means supplies toner into a developing device in accordance with a difference between a density of an unfixed toner image of an image area rate of 100% and a target value of the density.

11. An image forming apparatus according to claim 1, wherein said image quality controlling means comprises:

image quality changing means for changing the quality of the output image in accordance with an operation amount;

control case storing means for storing control cases of the output image;

control rule extracting means for extracting a control rule from the plural control cases stored in said control case storing means; and operation amount calculating means for, by using the control rule extracted by said control rule extracting means, calculating a new operation amount so that the quality of the output image coincides with the target quality, and supplying the new calculated operation amount to said image quality changing means.

12. An image forming apparatus, comprising:

image forming means of an electrophotographic type;

toner image measuring means for measuring an unfixed toner image of a reference pattern, the unfixed toner image being formed by said image forming means;

toner supply controlling means for controlling an amount of supplied toner on the basis of an output of said toner image measuring means;

image quality controlling means for controlling a quality of an output image on the basis of an output of said toner image measuring means;

state amount detecting means for detecting a state amount relating to an image formation;

image formation controlling means for causing said image forming means to form a fixed image of the reference pattern on a record medium, on the basis of a detection result of said state amount detecting means;

fixed image measuring means for measuring the fixed image of the reference pattern, the fixed image being formed by said image forming means; and sensitivity calibrating means for calibrating a sensitivity of said toner image measuring means on the basis of an output of said fixed image measuring means.

13. An image forming apparatus according to claim 12, wherein said fixed image measuring means measures the fixed image and an outputs image signal in an L*a*b color space, an L*C*h color space, or an XYZ color space.

* * * * *